United States Patent [19]

Cutler

[11] 4,421,315

[45] Dec. 20, 1983

[54] GAME

[76] Inventor: Alfred Cutler, 17657 Pomerado Rd., #252, Rancho Bernardo, Calif. 92128

[21] Appl. No.: 455,072

[22] Filed: Jan. 3, 1983

[51] Int. Cl.[3] ..... A63F 3/00

[52] U.S. Cl. ..... 273/268; 273/148 R; 273/272; 273/146

[58] Field of Search ..... 273/148 R, 145 B, 145 D, 273/268, 272, 299; 206/579

[56] References Cited

U.S. PATENT DOCUMENTS

| | | | |
|---|---|---|---|
| D. 265,663 | 8/1982 | Godberson | D21/41 |
| 1,238,522 | 8/1917 | Kalista | 273/268 X |
| 1,466,534 | 8/1923 | Kuen | 273/268 |
| 3,393,914 | 7/1968 | Hill | 273/272 |
| 3,652,086 | 3/1972 | Stecker | 273/148 R X |
| 3,744,800 | 7/1973 | Campbell | 273/268 |
| 3,747,934 | 7/1973 | Barrett | 273/268 |
| 3,840,236 | 10/1974 | Beskrone | 273/148 R X |
| 4,341,389 | 7/1982 | Dumont | 273/272 X |

FOREIGN PATENT DOCUMENTS

| | | | |
|---|---|---|---|
| 604005 | 1/1926 | France | 273/268 |
| 1345428 | 1/1974 | United Kingdom | 273/268 |

OTHER PUBLICATIONS

"Word Game" Washington Evening Star, Jul. 8, 1966, p. C-21.

*Primary Examiner*—Harland S. Skogquist
*Attorney, Agent, or Firm*—Charmasson & Holz

[57] ABSTRACT

A game is provided particularly for use by children in which a series of paddles can be moved from a first position into a second position according to the roll of dice. The object is to flip as many paddles over as possible before the player rolls a number with the dice that cannot be matched by a number on a paddle, or a sum of the numbers on the paddles, at which point the player is given a limited time to make as many words as he can from the letters which are exposed on the backside of the paddles as they lie in their second position. This develops in the child, and in the adult for that matter, the abilities of both spelling and simple addition.

5 Claims, 7 Drawing Figures

GAME

BACKGROUND OF THE INVENTION

There are a number of games that have been patented and marketed having paddles with numbers on one side, usually typically mounted on an axis in a frame or in a case, with the object of the game being to roll the dice, and then flipping over the paddle which has the number rolled on it (the number being actually the sum of the two numbers on the two dice), or, if the user had rather and if it is possible, the player can flip down any number of paddles which together add up to the number rolled on the dice. For example, if the two dice rolled turn up a 6 and a 4, the rolled number is 10. The player can flip over the 10 paddle, or the 9 and the 1; the 8 and the 2, the 2, 3, and 5, the 1, 2, 3, and 4, etc. Although the better mode of play generally requires flipping the largest number possible, as these numbers are used up the players ordinarily resort to flipping combinations of smaller numbers.

This game has been popular both as an adult gambling game, and as a children's game. Sometimes, for advertising purposes, the rear sides of the paddles each have a letter on it, such that when all paddles are in the second position, the letters spell out the name of a company or product.

Nonetheless, however, there is a need for a game of this general type but which takes the player one step farther. It is the primary purpose of this invention to provide the player not only with a game which is largely dictated by luck, but to add on a second phase of the game involving both skill and the education of youth.

SUMMARY OF THE INVENTION

The second phase of the game which is added by the instant invention comprises having the player create as many words as he can in a limited period of time, for example thirty or sixty seconds, from the alphabetical letters that are displayed on the backsides of the paddles, which appear when the paddles are in their second position. The entire alphabet is displayed if all paddles are moved into their second position, and of course skill and luck are integrated very much, inasmuch as failure to flip very many paddles into the second position obviously reduces greatly the number of vowels and consonants available to the player for the creation of words in the second phase of the game.

In addition, the game provides an opportunity for the increase in skill in at least two different ways. Clearly, the more one uses the game, the more one will identify the short words and techniques for quickly piecing together words which will help a seasoned player overcome his bad luck if he fails to overturn many of the paddles. In addition, however, the seasoned player will realize that there are certain letters, for example "A," "E," "O," as well as several consonants, that are used very often and easily in the creation of words, and which may be used a lot in three-letter words. For example, in the illustration, under the paddle with the 6 on the first side are the letters "N,O,P." This might prove to be handier than "H,I,J," as both the "N" and the "O" are fairly frequent in occurence in the English language. By knowing where the crucial consonants and syllables lie beneath the numbers, the player can take advantage of the opportunity to select certain combinations of paddles over others in response to the roll of the dice.

The invention will be more fully understood from the detailed description below.

DETAILED DESCRIPTION OF THE PREFERRED EMBODIMENT

Figure 1:
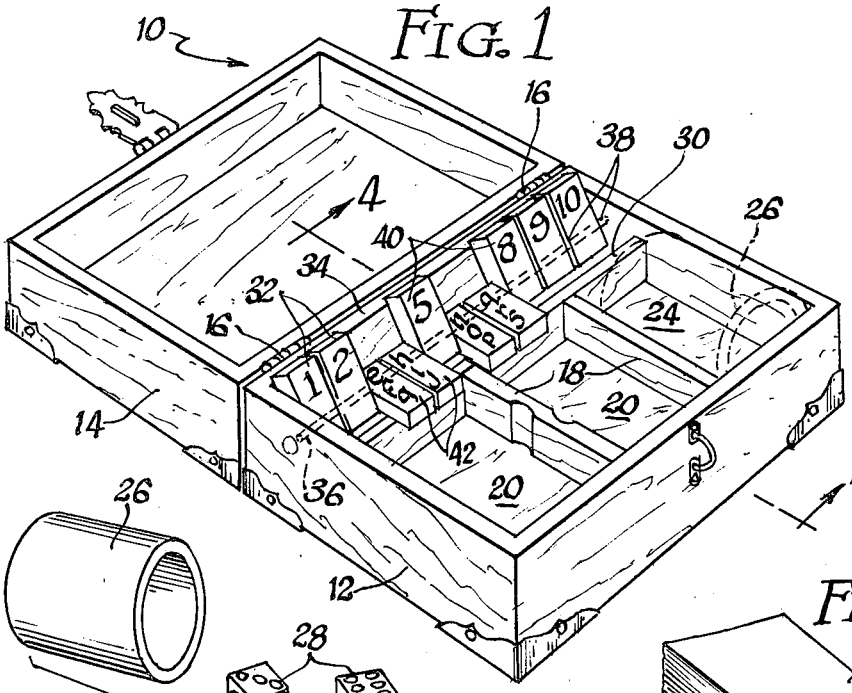
FIG. 1 is a perspective view of the game with the case in its open position, showing some of the paddles in the first position and some in the second position.
Figure 2:
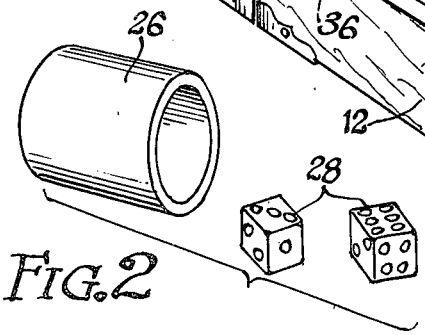
FIG. 2 is a perspective view of the dice cup with the dice.
Figure 3:
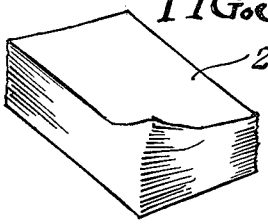
FIG. 3 illustrates a pad of score cards.
Figure 4:
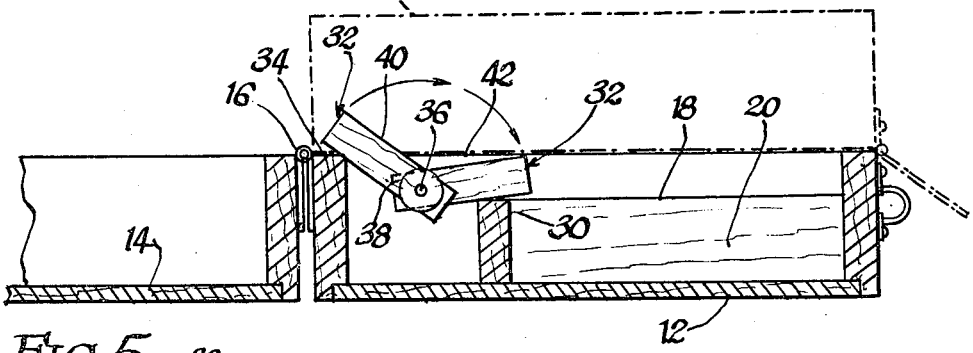
FIG. 4 is a section taken along line 4—4 of FIG. 1 illustrating in phantom the closure of the box, and indicating the flipping of a paddle from the first into a second position.
Figure 5:
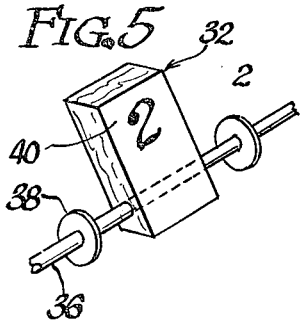
FIG. 5 is a perspective view of one paddle isolated on its axis.
Figure 6:
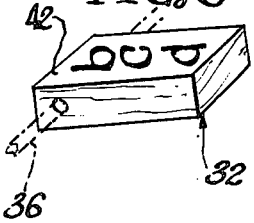
FIG. 6 is a perspective view of the paddle of FIG. 5 flipped into its second position.

The game has lightweight, attractive case 10 with a main body 12 and a lockable lid 14 which is hinged to the main body at 16. The top 14 makes a convenient dice-rolling compartment, and may be covered with felt or the like to reduce noise and to protect the dice.

The body portion of the case is divided by dividers 18 into two compartments 20 to hold score sheet pads 22 and also a couple of pencils. A third compartment 24 conveniently houses the dice cup 26 with the dice 28 inside. The rear wall of these compartments is defined by a transverse rib 30 extending up from the bottom of the case which also serves as the support for the paddles 32 when they are in the second position. In the first position, they are supported by the rear wall 34 of the body portion 12 of the case. The paddles are skewered in a sequence on axis 36 and are spaced slightly with washers 38 to avoid friction between adjacent paddles.

Each of the paddles of the front side 40 displays a numeral and a rear side 42 which displays letters from the alphabet. In the preferred embodiment, those paddles which display the numerals "1" and "10" on their first side display the letters "A" and "Z" on the rear side, with the remaining eight paddles in between each having three letters in sequence, so that the entire alphabet is displayed.

Figure 7:
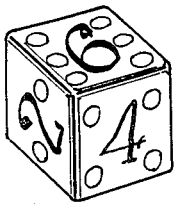
FIG. 7 is a perspective of a modified type of die.

Modifications of the game play and the structure could involve the rearranging of the letters, so that some letters might actually appear more than once to facilitate play, or one or more "wild cards" could be added in the form of symbols which could be used for any letter. The players could also be constrained in the minimum number of letters in any word, to increase the level of sophistication. Also, each letter could be assigned a particular number of points, so that use of the difficult to use letters would gain more points than the use of common vowels and consonants. A modified form of the die is shown in FIG. 7, large enough to display numerals on its face in addition to the dots, to help young children learn the numeric symbols associated with number values. This die or the standard type could be used singly especially after some of the paddles have been flipped, to enable the user to eliminate small numbered paddles readily.

In any of these modifications, clearly by the addition of the letters of the alphabet and the addition of the entire second mode of play, a game which formerly was so simple, and required such a low level of skill, as to lose the interest of all players other than those risking money on the roll of the dice, is now converted into an entertaining and educational game, familiarizing children with the spelling and construction of words. The invention also adds that ingredient to the game which is all but essential to any game other than a gambling game, namely, skill. Not only does it add the requisite that one be at least somewhat skillful in making words, but it also provides the above-mentioned dual means of improving one's score through practice, that is, both the increased facility in word construction over practice, and the ability to flip the paddles having specific letters on their backs early in the game, to ensure that the second phase would result in high scoring.

While the preferred embodiment of the invention has been described, other modifications may be made thereto and other embodiments may be devised within the spirit of the invention and the scope of the appended claims.

What is claimed is:

1. A Game comprising:

a case;

a random number generator stored in said case;

a plurality of paddles whose total number is lesser than the number of letters in the alphabet;

said paddles being pivotally mounted in said case in a sequence;

said paddles having first and second stable positions in which the first and second sides of same are respectively exposed to the user;

said first sides each displaying a numeral such that the aggregate of said numerals are consecutive in said sequence;

said second sides each displaying at least one alphabetical letter such that said paddles can be flipped by the player into the second position responsive to numbers obtained from the random number generator in an attempt to make a word from the letters displayed on the second sides of said flipped paddles; wherein said second sides together display the entire alphabet; and said paddles are limited to ten, and the first side of each of said paddles displays one of the numerals from "1" through "10", the first and last paddle in said paddle sequence displaying the letters "A" and "Z", respectively, and the other paddles in the sequence each displaying three alphabetically sequential letters; and wherein said random number generator comprises at least one die.

2. Structure claimed in claim 1 wherein each side of said die is marked with one of the numerals from 1 through 6 and with a number of dots corresponding to said numeral.

3. Structure according to claim 1 wherein said case defines at least one dice cup compartment, a score card compartment, and has a hinged cover defining a dice rolling area.

4. Structure according to claim 3 and including a lateral rib defining the rear edges of said compartment and acting as a support to support said paddles in the second position.

5. Structure according to claim 4 wherein said case has a body portion and said paddles rest on the rear wall of said body in said first position.

* * * * *